US005587052A

United States Patent [19]

Autio et al.

[11] Patent Number: 5,587,052

[45] Date of Patent: Dec. 24, 1996

[54] APPARATUS AND METHOD FOR TENSIONING A FABRIC IN A PAPER MACHINE

[75] Inventors: Jukka Autio, Karstula; Timo Kujala, Jyvaskyla, both of Finland

[73] Assignee: Valmet Corporation, Helsinki, Finland

[21] Appl. No.: 189,115

[22] Filed: Jan. 27, 1994

[30] Foreign Application Priority Data

Jan. 29, 1993 [FI] Finland ..... 930398

[51] Int. Cl.[6] ..... D21F 3/00

[52] U.S. Cl. ..... 162/273; 162/274; 242/417.3

[58] Field of Search ..... 242/417, 417.2, 242/417.3; 162/200, 272, 274, 273

[56] References Cited

U.S. PATENT DOCUMENTS 3,966,106 6/1976 Randpalu ..... 226/42
4,256,537 3/1981 Stanislaw ..... 162/273

FOREIGN PATENT DOCUMENTS 84504 12/1987 Finland .
881290 9/1989 Finland .
2279886 2/1976 France .
3026429 1/1981 Germany .

*Primary Examiner*—Brenda A. Lamb
*Attorney, Agent, or Firm*—Steinberg, Raskin & Davidson P.C.

[57] ABSTRACT

An apparatus and method for tensioning a fabric in a paper machine, such as a press felt, a drying wire, or an equivalent fabric, including a tensioning roll arranged inside a loop of the fabric. Bearing supports of the roll are fixed, at the driving side and at the operating side of the machine, to sledges. These sledges are displaced by a motor, synchronously in relation to one another, so as to tighten the fabric that runs over the tensioning roll to a certain tension. The sledges are arranged in connection with the frame part of the machine on linear guides, which can be loaded in different directions transverse to the direction of movement of the sledges. In view of displacing the sledges, shafts operated by a motor are journalled on the sledges. The shafts are interconnected by a synchronization shaft between the driving side and the operating side.

19 Claims, 12 Drawing Sheets

APPARATUS AND METHOD FOR TENSIONING A FABRIC IN A PAPER MACHINE

BACKGROUND OF THE INVENTION

The present invention relates to an apparatus and method for tensioning a fabric in a paper machine, such as a press felt, a drying wire, or an equivalent fabric, comprising a tensioning roll arranged inside a loop of the fabric, bearing supports for supporting the roll which are fixed to sledges at the driving side and at the operating side of the machine. The sledges are displaced by a motor, synchronously in relation to one another, to tighten the fabric that runs over the tensioning roll to a certain, desired tension.

In a paper machine, various wires and fabrics are used, such as forming wires, drying wires, and press felts, for all of which the general designation "fabric" will be used in the following description. The loops of these fabrics must be tensioned to a certain tension T, which is generally set in the range of from about 1 kN/m to about 5 kN/m. Moreover, inside the fabric loops, an alignment roll is often used so that by regulating the axial alignment of the alignment roll, the transverse position of the fabric is controlled.

In the prior art, a number of different devices for tensioning the fabrics in a paper machine are known. The device that is most commonly used is probably a tensioning device in which the tensioning roll is mounted at the operating side and at the driving side of the machine on carriages. The carriages are displaced synchronously with one another on rollers inside a box beam attached to the frame part of the paper machine.

In addition, some of the prior art devices are not very rigid, but rather have a large amount of play. This causes drawbacks, such as a tendency of vibration, which are detrimental to the operation of the tensioning devices.

OBJECTS AND SUMMARY OF THE INVENTION

It is an object of the present invention to provide a novel apparatus for tensioning fabrics, such as a press felt or a drying wire or equivalent, by whose means the drawbacks of the prior art devices are substantially eliminated. A typical prior art fabric-tensioning devices and its associated drawbacks and disadvantages will be described in more detail later with reference to FIGS. A and B in the accompanying drawings.

It is another object of the present invention to provide a new and improved method for tensioning a fabric in a paper machine in which the drawbacks of the prior art methods are substantially eliminated.

In view of achieving the objects stated above, and others, in the present invention, sledges are arranged in connection with the frame part of the machine on linear guides which can be loaded in different directions transverse to the direction of movement of the sledges. In view of the displacement of the sledges, shafts operated by a motor are journalled on the sledges. The shafts are interconnected by means of a synchronization shaft between the driving side and the operating side of the machine.

In accordance with the present invention, an apparatus for tensioning a fabric in a paper machine is provided that has a small size (smaller than that of the prior art fabric-tensioning devices), a low friction, and whose position can be adjusted precisely without hysteresis. The present invention also provides the advantage that the suspension of the tensioning apparatus can be made almost free of play and, thus, rigid and less susceptible to detrimental vibrations.

It is another advantage of the present invention that, when linear guides in accordance with the present invention are used, the sledges of the tensioning apparatus can be supported in all directions transverse to their directions of movement. For this reason, the tensioning apparatus can be placed, without changes in the construction, in any position whatsoever, even in a position hanging down on support of its linear guides.

It is a further advantage of the present invention that the tensioning apparatus in accordance with the invention can be assembled and tuned outside the machine and then be installed in its site of operation afterwards. This aspect is important because the ball-bearing linear guides, which are preferably used in the invention, require very precise installation.

In the apparatus for tensioning a fabric in a paper machine in accordance with the present invention, a tensioning roll is arranged in a loop of a fabric and bearing supports are positioned to support ends of the tensioning roll. The bearing supports are fixed to sledges, one at each of the driving side and the operating side of the apparatus. A drive motor moves the sledges, preferably synchronously in relation to one another to thereby tighten the fabric that runs over the tensioning roll to a desired tension. Linear guide means are arranged to guide the movement of the sledges and can be loaded in different directions transverse to the direction of movement of the sledges. Power-driven drive shafts are journalled by bearings on the sledges and operated by the drive motor to displace the sledges. The shafts on the driving side and the operating side of the apparatus are interconnected by a synchronization shaft. The motor is connected to one of the sledges situated at the operating side of the apparatus.

The guide means preferably comprise a pair of linear guide rails arranged parallel to one another at each of the driving side and the operating side of the apparatus and at least two linear ball-bearing units connected to each of the sledges. The parallel guide rails are spaced a short horizontal distance from one another. The linear ball-bearing units are arranged to cooperate with each pairs of guide rails. Indented racks are connected to the frame of the apparatus and are arranged proximate to the linear guide rails, preferably in gaps between pairs of such guide rails. The racks have teeth arranged on an outer face thereof to cooperate in a toothed engagement with cogwheels situated on the drive shafts. In this manner, rotation of the drive shafts against the stationary racks causes movement of the sledges on which the drive shafts are journalled. The teeth on the racks are arranged in relation to a support plane of the guide rails such that the distance between them is about 100 mm to about 200 mm. Further, the apparatus has a relatively small height from the support plane of the guide rails to a central axis of the tensioning roll, only about 600 mm.

In another embodiment of the present invention, the fabric is a press felt and the apparatus includes a splice-turning device having a power unit arranged between one of the bearing supports and the sledge connected thereto. Linear guide fittings are arranged on the sledges so that a worm gear is rotated by the drive shaft and displaces the bearing support in the guide fittings. Telescopic box constructions may also be arranged to cover the racks and spaces between the guide rails.

In the method for tensioning a fabric in a paper machine in accordance with the present invention, a tensioning roll is arranged in a loop of a fabric and ends of the tensioning roll are supported on bearing supports which are secured to sledges. The sledges are moved to tighten the fabric that runs over the tensioning roll to a desired tension. Linear guides are fixed to a frame of the machine to guide the movement of the sledges, and comprise a pair of linear guide rails arranged parallel to one another at each of the driving side and the operating side of the apparatus, and at least two linear ball-bearing units connected to the sledges and arranged to cooperate with each pair of guide rails. Racks are provided which are connected to the frame and arranged in gaps between the pairs of linear guide rails. The racks have teeth arranged on an outer face thereof. Power means direct a force to rotate drive shafts journalled on the sledges, and which have cogwheels connected thereto. The cogwheels engage with the teeth of the racks in a toothed engagement such that rotation of the shafts causes movement of the sledges along the stationary racks.

In a preferred embodiment, the sledges and linear guides are arranged substantially symmetrical in relation to a vertical center plane in the machine direction of the apparatus. The fabric may be a press felt, in which case the alignment of the tensioning roll can be changed by displacing one of the bearing supports to a desired position. This is achieved by arranging a splice-turning device between that bearing support and the sledge arranged in connection therewith, arranging linear guide fittings on the sledges, and arranging a worm gear to be rotated by a shaft to displace that bearing supports in the guide fittings.

In the following, the prior art most closely related to the invention, problems associated with the prior art devices, and some preferred embodiments of the invention will be described in more detail with reference to the figures in the accompanying drawing.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
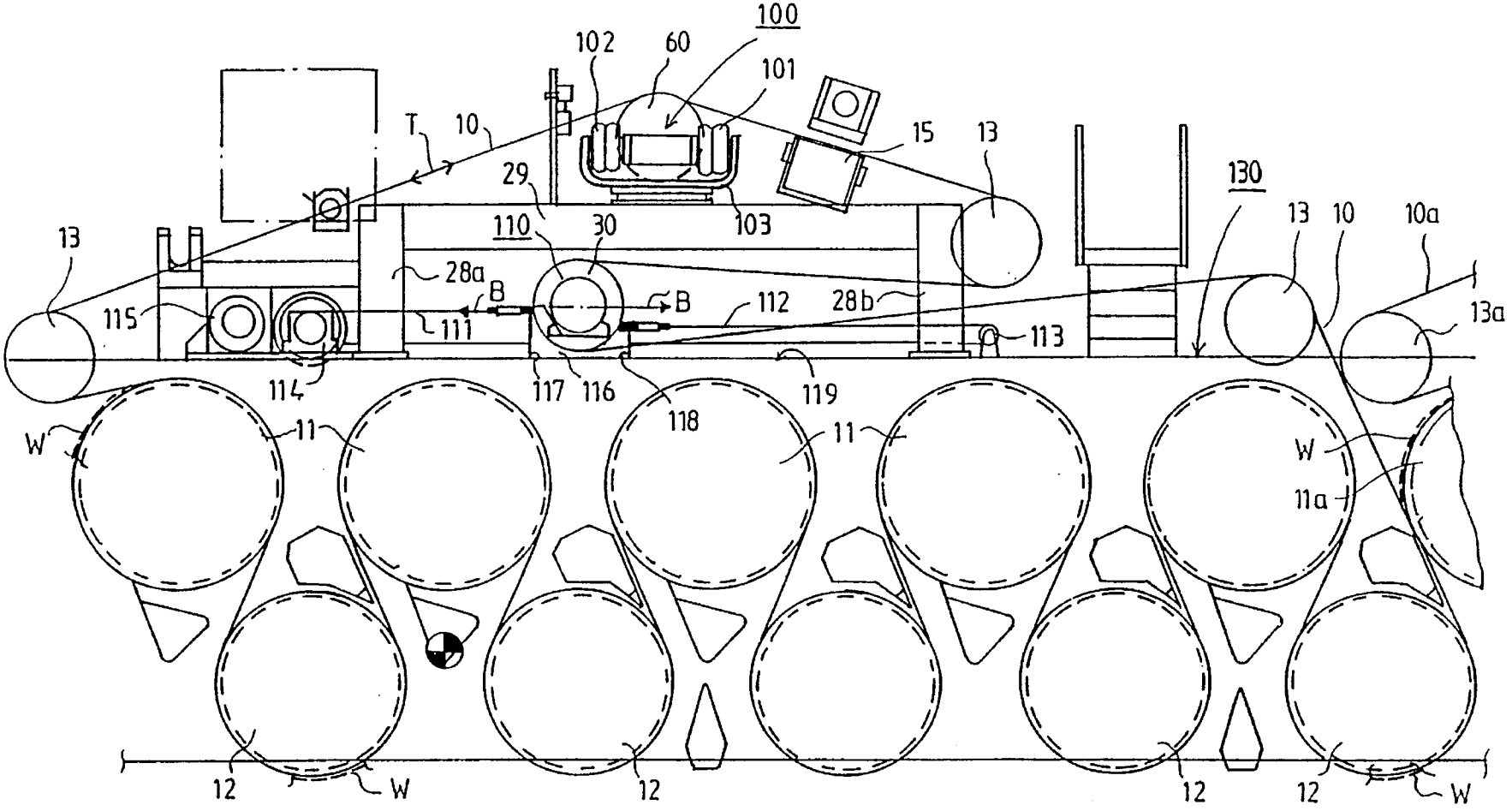
FIG.1A PRIOR ART
FIG. 1A shows a prior-art tensioning device for a drying wire in the dryer section of a paper machine.

FIG. 1A is a schematic side view of a single-wire group in a multi-cylinder dryer of a paper machine, in which a prior art drying-wire tensioning device 110 and an alignment device 100 are used. The dryer group shown in FIG. 1A comprises drying cylinders 11 arranged in an upper row and reversing suction cylinders 12 arranged in a lower row below the upper row of cylinders 11. The drying wire 10 is passed over the cylinders 11, 12 so that, on the upper cylinders 11, a paper web W to be dried is placed in direct contact with and against the heated faces of the cylinders 11. On the reversing suction cylinders 12, the paper web is placed at the side of the outside curve. At the right side of FIG. 1A, the drying wire 10*a* of the next cylinder group, its guide roll 13*a*, and the drying cylinder 11*a* are shown. The drying wire 10 is conditioned by means of the conditioning devices 15. On the top of a frame part 130 of the dryer group, there is an auxiliary frame which comprises vertical parts 28*a* and 28*b* as well as a horizontal part 29. The prior art alignment device 100 for the drying-wire 10 is arranged on the horizontal part 29 of the auxiliary frame. The axial alignment of the alignment roll 60 in the alignment device 100 is controlled by means of bellows 101 and 102 placed inside a U-shaped frame part 103 of the alignment device 100.

The drying wire 10 is guided by guide rolls 13 and tensioned by tensioning roll 30 in a tensioning device 110. The prior art tensioning device 110 as shown in FIG. 1A comprises a tensioning roll 30 mounted on a carriage 116. The carriage 116 is displaced on wheels 117 and 118 on a beam 119 by means of cables 111 and 112, which run over reversing pulleys 113 and 114. Pulley 114 is driven by a motor 115. When the carriage 116 and the connected tensioning roll 30 are displaced by means of the motor 115 in the direction of arrow B, the tension T of the loop of the drying wire 10 can be regulated as desired.

A particular drawback in the tensioning device 110 as shown in FIG. 1A is the high friction and the great play at the suspension of the carriage 116 and at the guides. The large amount of play, i.e., flexibility, causes detrimental vibrations in the operation of the tensioning device 110. Further, the construction of this prior art device is quite spacious, as its length in the machine direction is typically from about 5 meters to about 6 meters. Between the fastening points of the cables 111 and 112 and the rollers or wheels 117,118, there is a considerable distance, which produces a detrimental torsion. These drawbacks are avoided by means of the apparatus in accordance with the present invention for tensioning a drying wire as shown in FIG. 1C as will be described later.

In the following, with reference to FIG. 1B, a prior art tensioning device 120 for a press felt 20 of the press section in a paper machine and the environment of application of this device will be described.

Figure 1B:
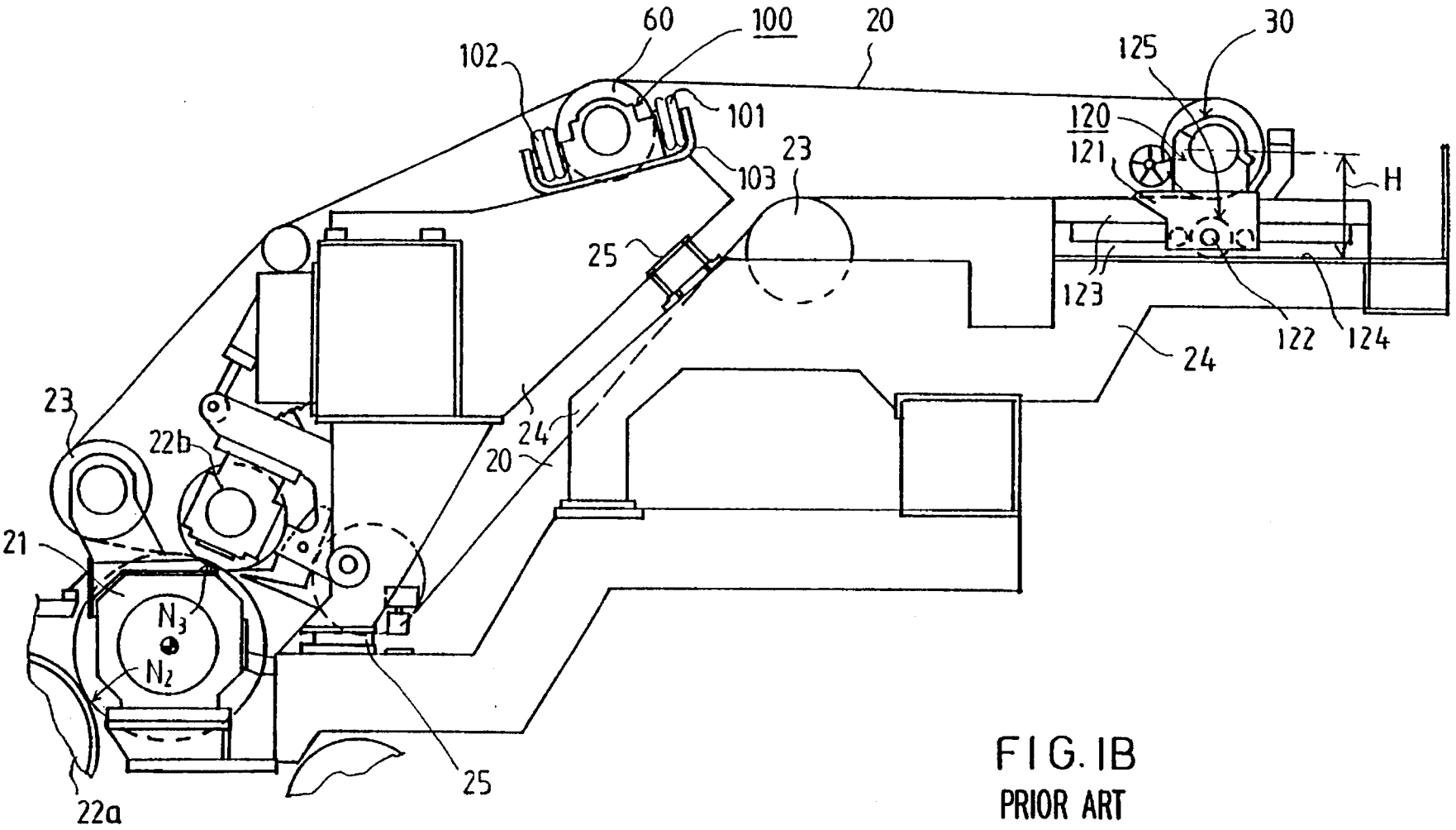
FIG. 1B PRIOR ART
FIG. 1B shows a prior-art upper-felt tensioning device in the dryer section of a paper machine.
Figure 1C:
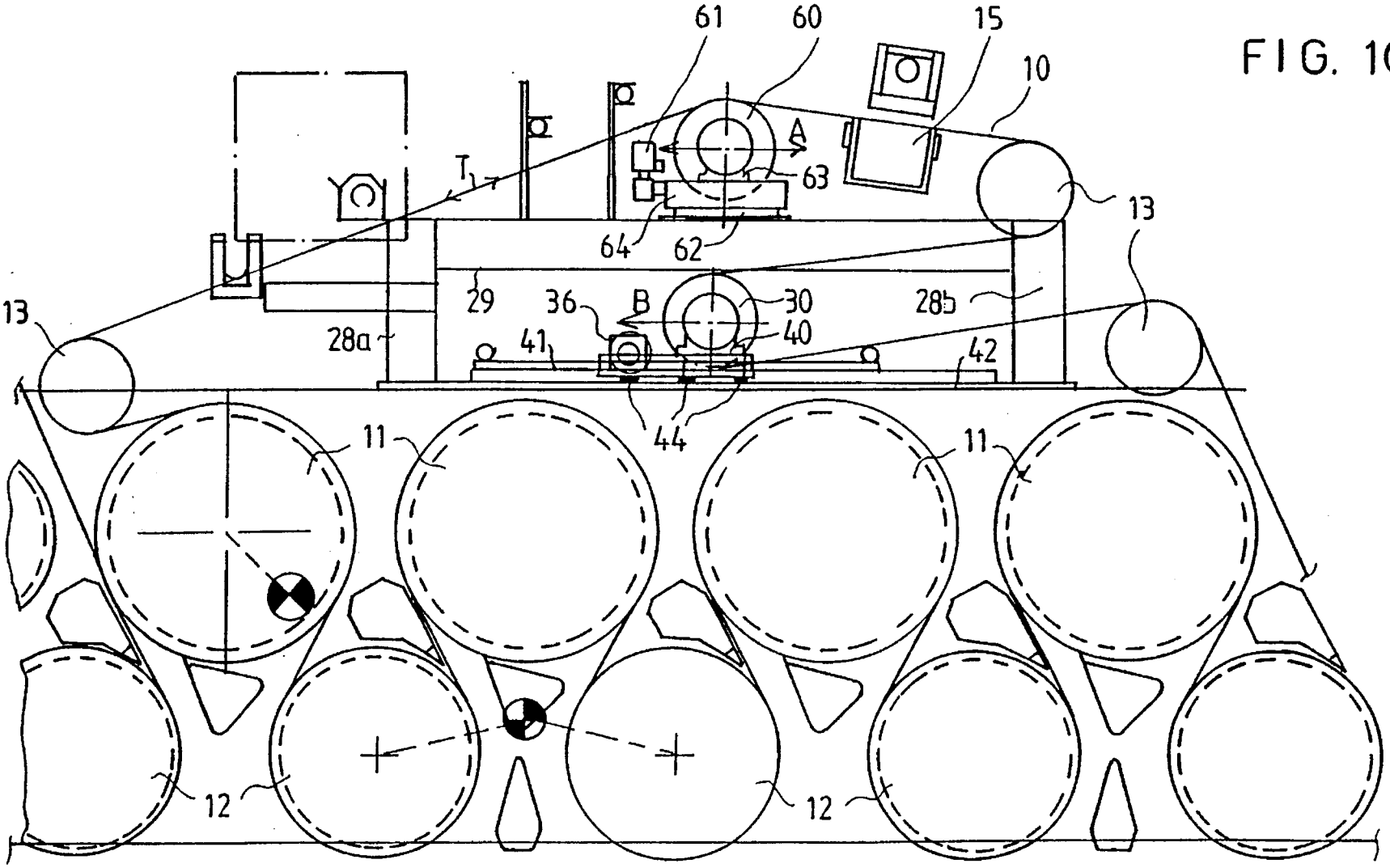
FIG. 1C shows an apparatus in accordance with the present invention and used in a method in accordance with the present invention for tensioning a drying wire in a dryer section, in a manner corresponding to FIG. 1A.

FIG. 1B shows a compact press section of a paper machine, which press section comprises a suction roll 22*a*, a smooth-faced center roll 21, and a press roll 22*b*. In connection with the center roll 21, the second and the third nip N2 and N3 of the press section are formed. The first press nip (not shown) is formed underneath the suction roll 22*a*. Through the nip $N_3$, the press felt 20 runs guided by guide rolls 23 and by alignment roll 60, and is tensioned by tensioning roll 30. In connection with the frame part 24 of the paper machine, at the operating side of the machine, there are openable intermediate pieces 25 such that the upper felt 20 can be replaced when the pieces 25 are in their open position. In this prior art arrangement, the alignment device 100 for the control of the transverse position of the upper felt is substantially similar to that described above with respect to FIG. 1A.

Figure 2:
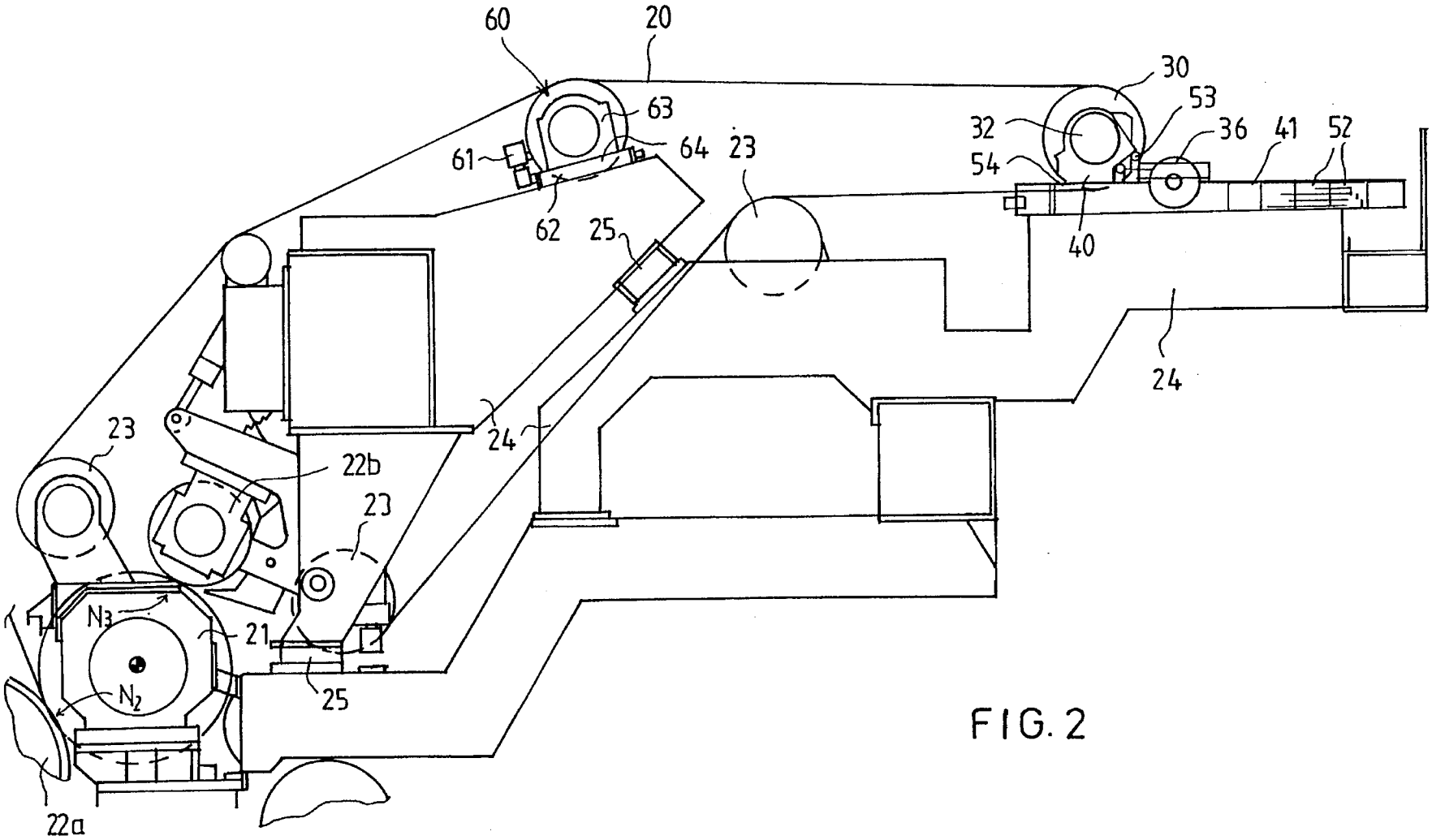
FIG. 2 shows an apparatus in accordance with the present invention and used in a method in accordance with the present invention for tensioning an upper felt in a dryer section, in a manner corresponding to FIG. 1B.

FIG. 1B also shows a prior art tensioning device 120 for a felt 20 which comprises carriages 121 placed at the driving side and at the operating side of the machine. In the tensioning device 120, the tensioning roll 30 of the felt loop is mounted in connection with carriage 121. The carriage 121 is arranged to move on guides 123 mounted on the frame parts and is operated by a drive shaft 122. The device 120 includes a stationary rack 124, in connection with which there is the cogged wheel 125 on the drive shaft 122 so as to displace the carriage 121 and thereby tension the felt 20. At both ends of the shaft 122, hydraulic motors are arranged, from whose pressures the tensioning force of the device 120 can be measured. The construction of the tensioning device 120 involves some of the same drawbacks as the tensioning device 110 as described above for the drying-wire 10, and, moreover, the tensioning device is spacious in the vertical direction (H≈1200 mm), i.e., has a larger requirement for space in the vertical direction. Further, the rigidity of this prior art device is quite small, which causes drawbacks, such as a tendency of vibration which are detrimental to the operation of the tensioning devices 110,120. These drawbacks are eliminated by means of the novel apparatus in accordance with the present invention for tensioning an upper press felt as shown in FIG. 2.

Referring to FIG. 1C, the principal features of the construction of the apparatus in accordance with the present invention for tensioning a drying wire 10 will be described. The environment of application was described above in relation to FIG. 1A. FIG. 1C also schematically shows the apparatus for displacement of the alignment roll 60, which apparatus comprises a sledge 64, on which one of the bearing supports 63 of the alignment roll 60 is mounted. The sledge 64 is displaced in the direction of A, i.e., in a substantially linear direction, on a guide 62 arranged on the frame part 29 by means of the power of a motor 61 or other displacement means.

Figure 4:
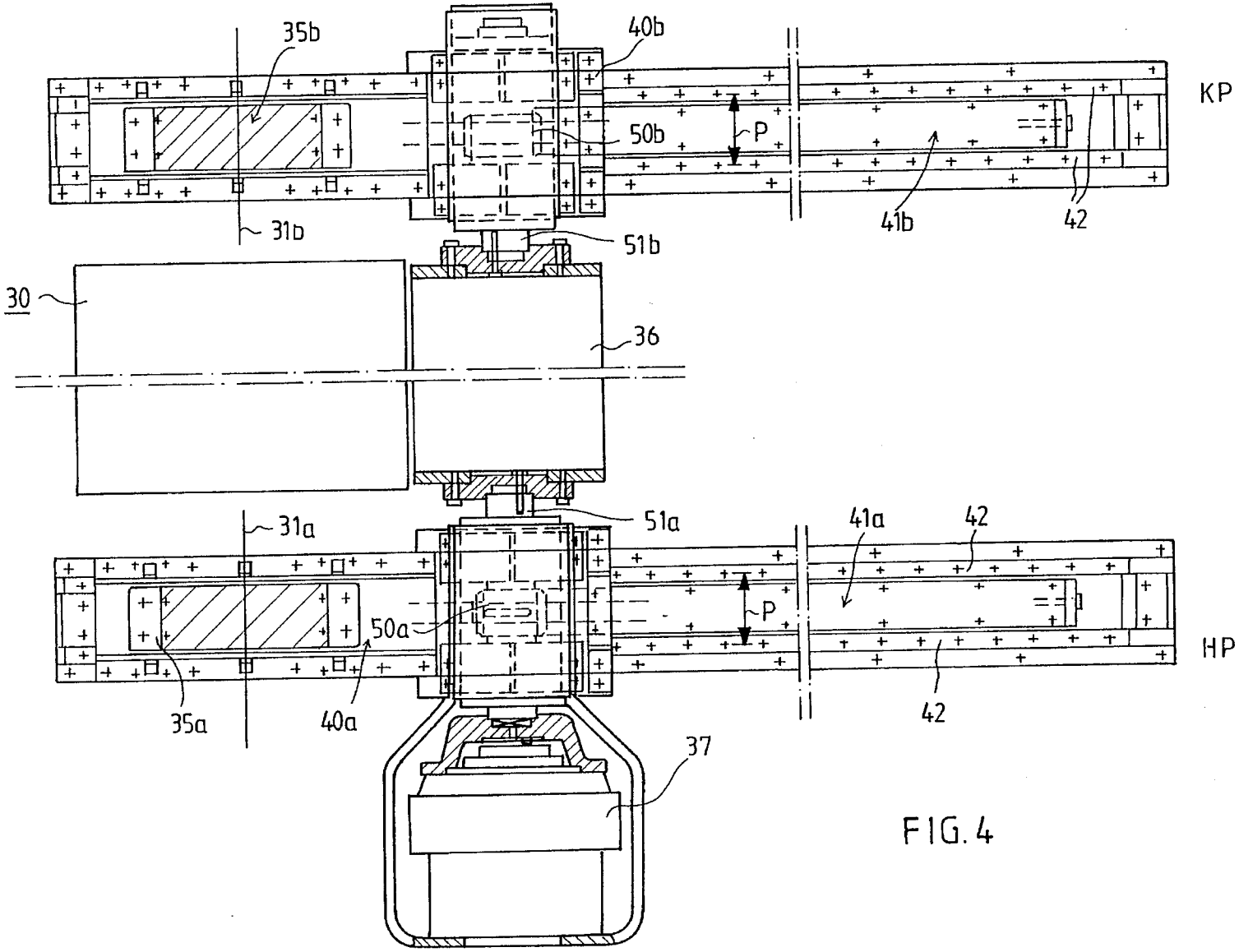
FIG. 4 shows a top view of the press section tensioning apparatus as shown in FIG. 1C.
Figure 5:
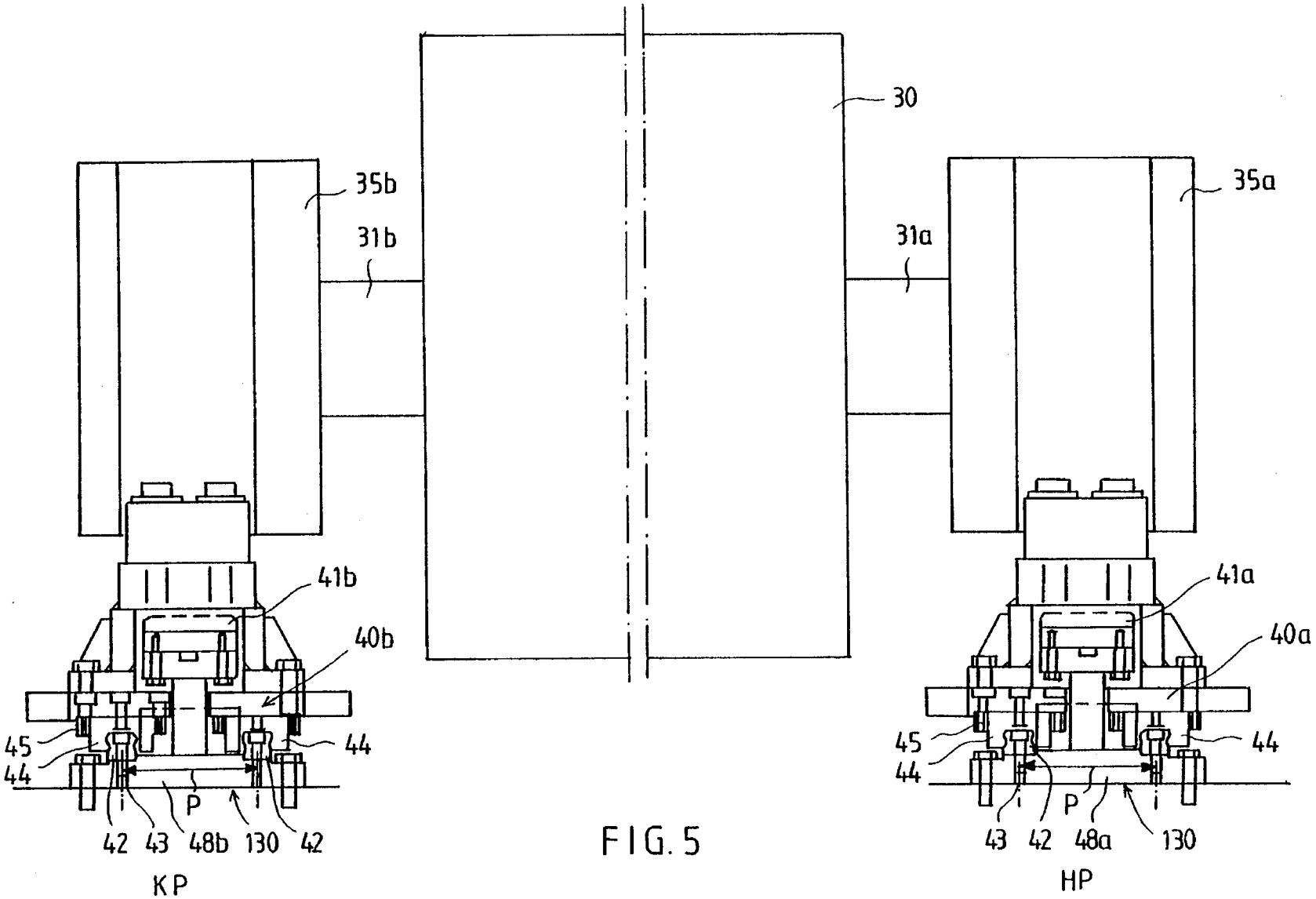
FIG. 5 shows the press section tensioning apparatus as viewed in the direction C—C indicated in FIG. 3.

As shown in FIG. 1C, axle journals 31*a* and 31*b* (FIG. 4) of the tensioning roll 30 for the drying wire 10 are mounted on sledges 40 by means of bearing supports 35. The sledges 40 are arranged to be displaceable along the linear guides 42,44 in the direction of arrow B by means of a shaft 36 driven by a drive motor 37 so as to tension the wire 10. Shaft 36 is also referred to as a synchronization shaft as it enables the motor 37 to displace the sledges 40 synchronously in relation to one another. Other power means may be used instead of the drive motor and other types of synchronization means instead of the synchronization shaft may also be used in accordance with the present invention.

Figure 6:
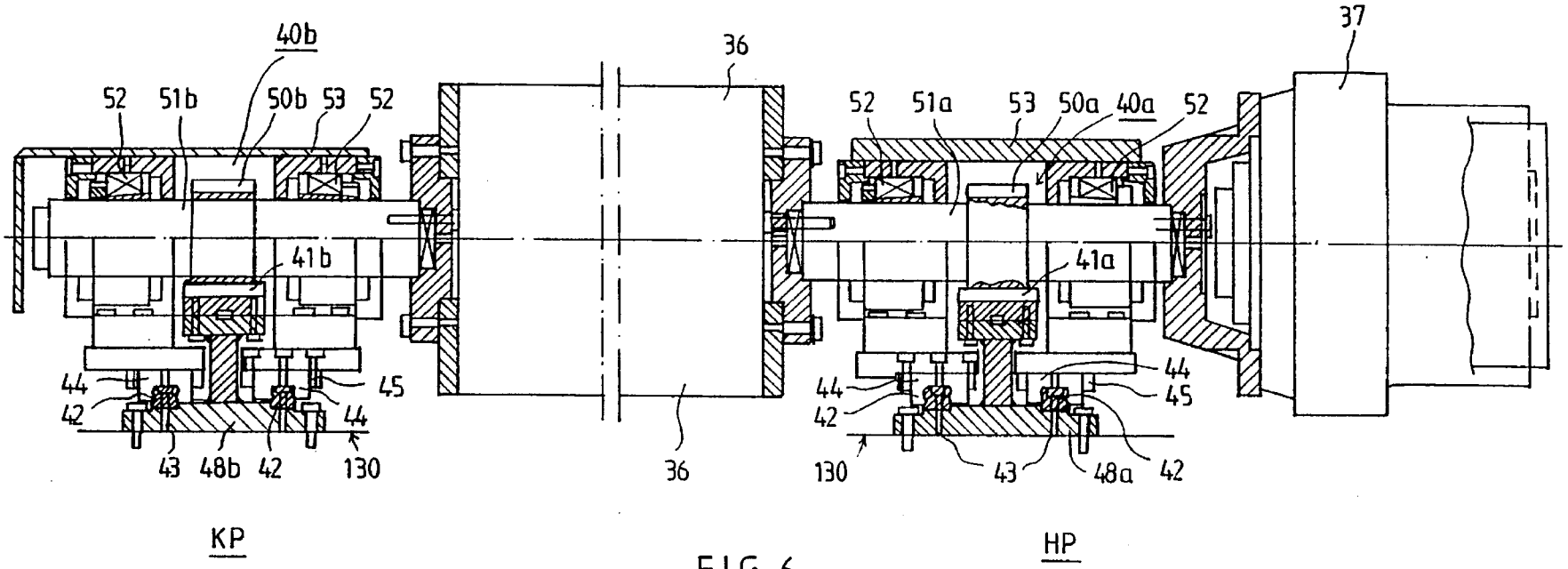
FIG. 6 shows a vertical section view taken along the lines D—D in FIGS. 3 and 7.

Referring to FIGS. 3 to 6, a preferred exemplifying embodiment of the construction of a wire 10 tensioning apparatus placed in a position as shown in FIG. 1C will be described. By means of the tensioning apparatus, the tensioning roll 30 can be displaced in the direction of arrow B, in a substantially linear direction, so that the wire 10 can be brought to the desired tension, which is generally in the range of from about 1 kN/m to about 5 kN/m. The tensioning roll 30 is journalled by means of its axle journals 31*a*,31*b* in bearing supports 35*a*,35*b*, which are attached to the sledges 40*a*,40*b* of the tensioning device. In the reference denotations, a refers to devices at the operating side (HP), and b to devices at the driving side (KP). With the exception of the drive motor 37, the construction can be made symmetric in relation to the vertical center plane in the machine direction. The drive motor 37 is fixed to the sledge 40*a* at the operating side, whose shaft 51*a* is mounted by means of bearings 52 on the sledge 40*a*. The shaft 51*a* is connected to the shaft 51*b* at the driving side by means of an intermediate shaft 36. Shaft 51*b* is mounted on the sledge 40*b* at the driving side by means of bearings 52 (FIG. 6). On the frame part 130 of the dryer section, base plates 48*a*,48*b* are fixed, on which the pairs of guides 42 are fixed. Guides 42 are placed at a small horizontal distance (P), which is from about 100 mm to about 300 mm, from one another. On the pairs of guides 42, linear bearings 44 move. The construction of linear bearings 44 will be described in more detail later with reference to FIG. 10. The bearings 44 are attached to sledges 40*a* and 40*b*. On support of the base plates 48*a*,48*b* and in the spaces between the pairs of guides 42, racks 41*a*,41*b* are attached. Cogwheels 50*a*,50*b* are situated on the shafts 51*a*,51*b* which are driven by the motor 37, and are in a tooth engagement with racks 41*a*,41*b*. In this manner, a power transmission arrangement is formed from the motor 37 for displacement of the sledges 40*a*,40*b*, synchronized by means of the shaft 36, so as to tension the loop of the drying wire 10 in the direction of arrow B as indicated in FIG. 1C. In this manner, rotation of the shaft 36 causes rotation of the cogwheels 50*a*,50*b* against the stationary racks 51*a*,51*b* which cause the sledges 40*a*,40*b* to be moved along the racks 51*a*,51*b*.

Figure 3:
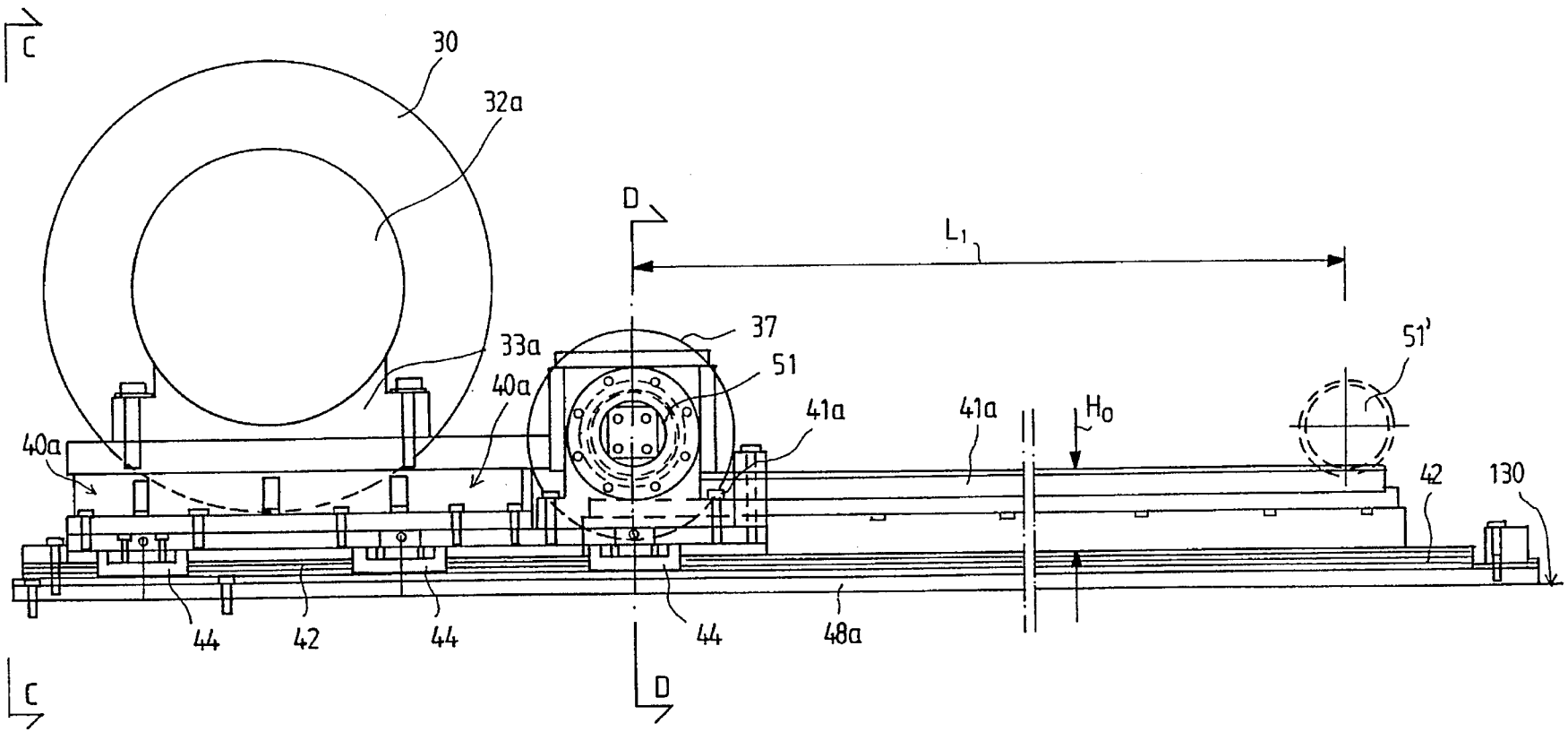
FIG. 3 is a side view of the press section tensioning apparatus as shown in FIG. 1C.

In FIG. 3, the tensioning roll 30 with its sledges 40*a*,40*b* is shown in its left extreme position, and so is the shaft 51, whose right extreme position is, in FIG. 3, denoted with the reference 51'. Thus, the tensioning roll 30 and its sledges 40*a*,40*b* can move along the linear guides 42 through the distance $L_1$.

In the construction shown in FIG. 3, the relative distance $H_o$ between the plane of support of the linear guides 42,44 and the racks 41*a*,41*b* can be made relatively short, preferably $H_o$ is from about 100 mm to about 200 mm. Thus, the raising force produced by the transmission between the motor 37, the drive shafts 51, the cogwheels 50*a*,50*b*, and the racks 41*a*,41*b* is reduced. The raising force is received by four linear ball-bearing units 44, which are carrying in four opposite directions.

Referring to FIGS. 2, 7, 8 and 9, another preferred exemplifying embodiment of the construction and operation of a press-felt 20 tensioning apparatus in accordance with the present invention, placed in a position as shown in FIG. 2 and used for tensioning an upper felt, will be described. In FIG. 2, the tensioning apparatus is placed on the frame part 24 of the press, and the construction and the operation are substantially similar to those described in relation to FIGS. 3–6. In all the FIGS. 1C and 2–10, the same reference denotations are used for corresponding parts. The constructions are, to an extent, similar such that FIG. 6, which was described above is a sectional view taken along the line D—D of both in FIG. 3 and in FIG. 7. Thus, in the following, only those features will be described in whose respect the tensioning apparatuses for the press felt 20 tensioning roll illustrated in FIGS. 7, 8 and 9 differ from the corresponding apparatuses for the drying wire 10, illustrated above in FIGS. 3–6.

Figure 7:
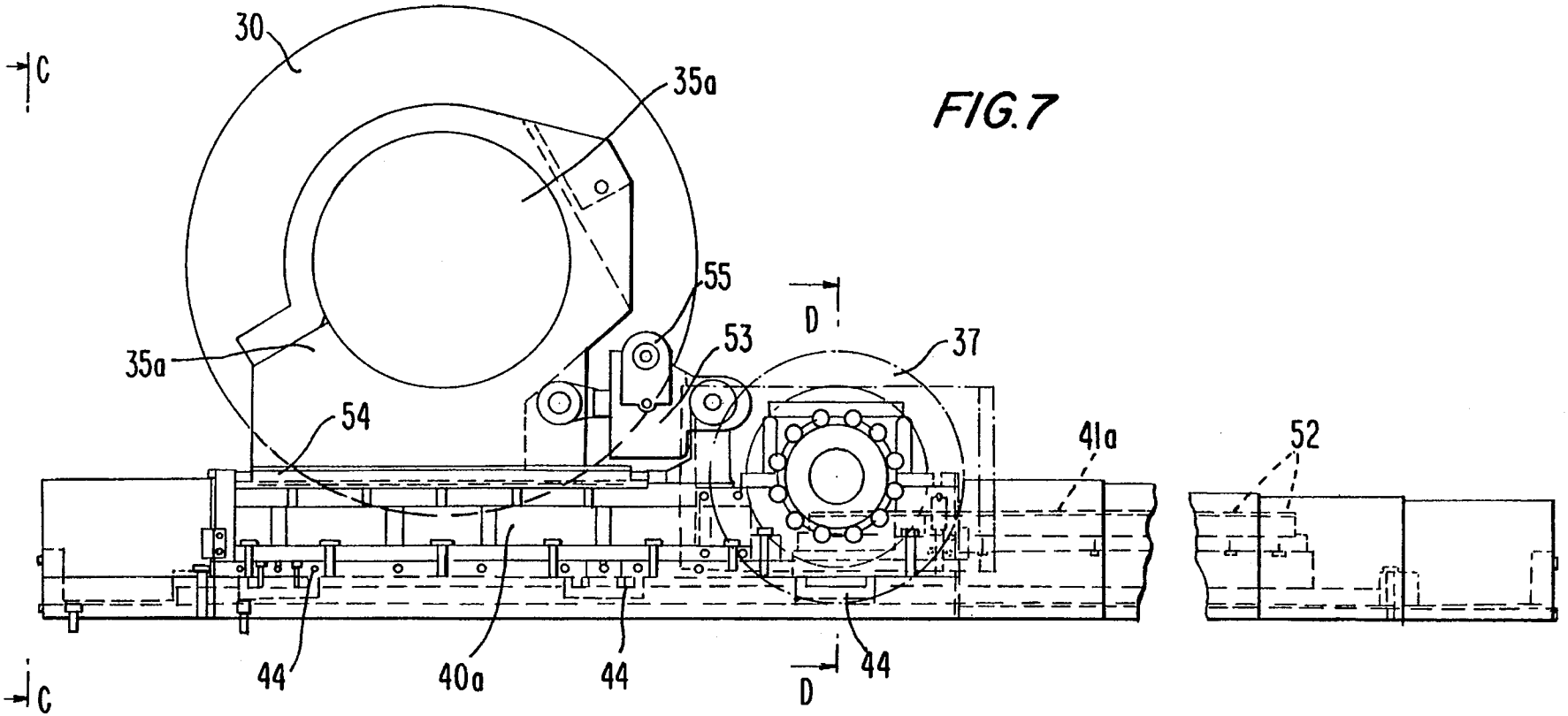
FIG. 7 shows the apparatus as shown in FIG. 2 for tensioning of a felt loop in a press section, in a manner corresponding to FIG. 3.
Figure 8:
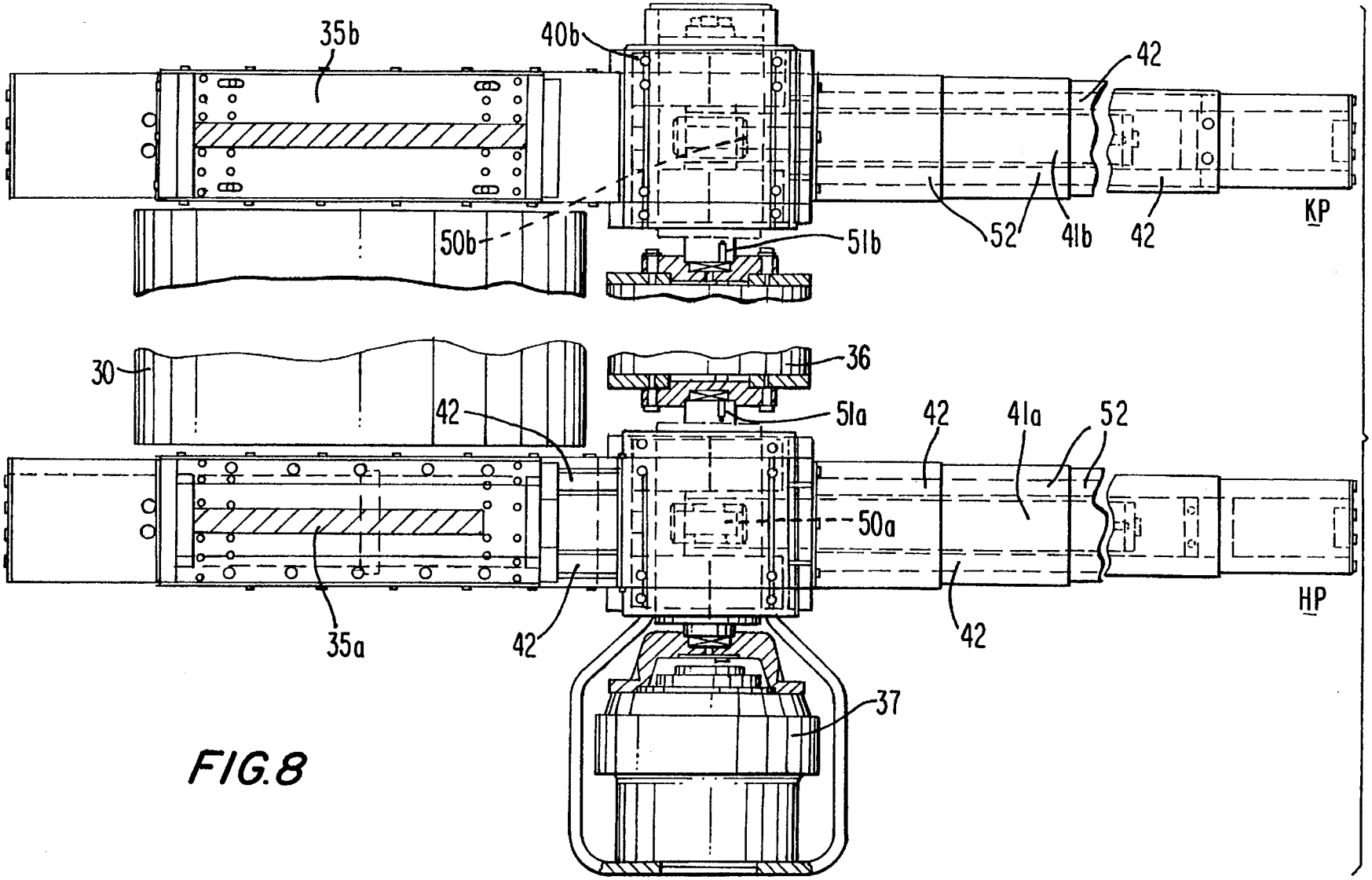
FIG. 8 shows a top view of the tensioning apparatus as shown in FIG. 7.
Figure 9:
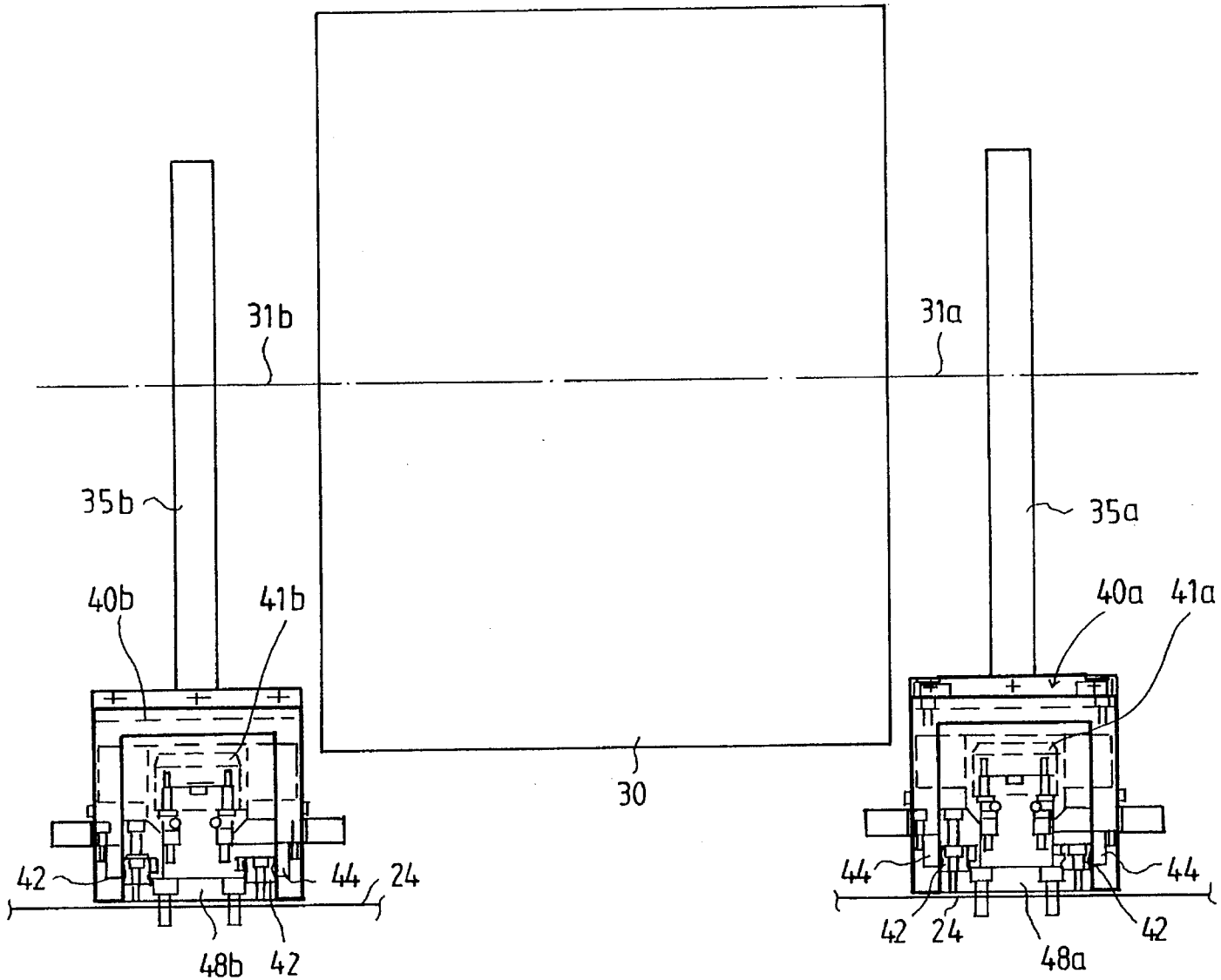
FIG. 9 shows the apparatus as shown in FIGS. 7 and 8 as viewed in the direction C—C indicated in FIG. 7.

In the apparatus shown in FIGS. 7–9, a telescopic deck construction 52 is situated above the guides 42 and above the racks 41*a*,41*b* placed between the guides. The telescopic deck construction prevents the access of contaminations, such as splashes, to the guide parts.

Moreover, in FIG. 7, a so-called splice-turning device 53 is shown, by whose means the alignment of the tensioning roll 30 can be altered slightly by shifting the bearing support 32*a* in relation to the sledge 40*a*. The splice-turning device 53 comprises a power unit, e.g., a worm gear, rotated by a drive shaft 55. By means of the worm gear, the bearing support 32*a* is displaced in the glide guides or linear guide fitting 54 of the sledge 40*a* in order to regulate and change the alignment of the tensioning roll 30.

Figure 10:
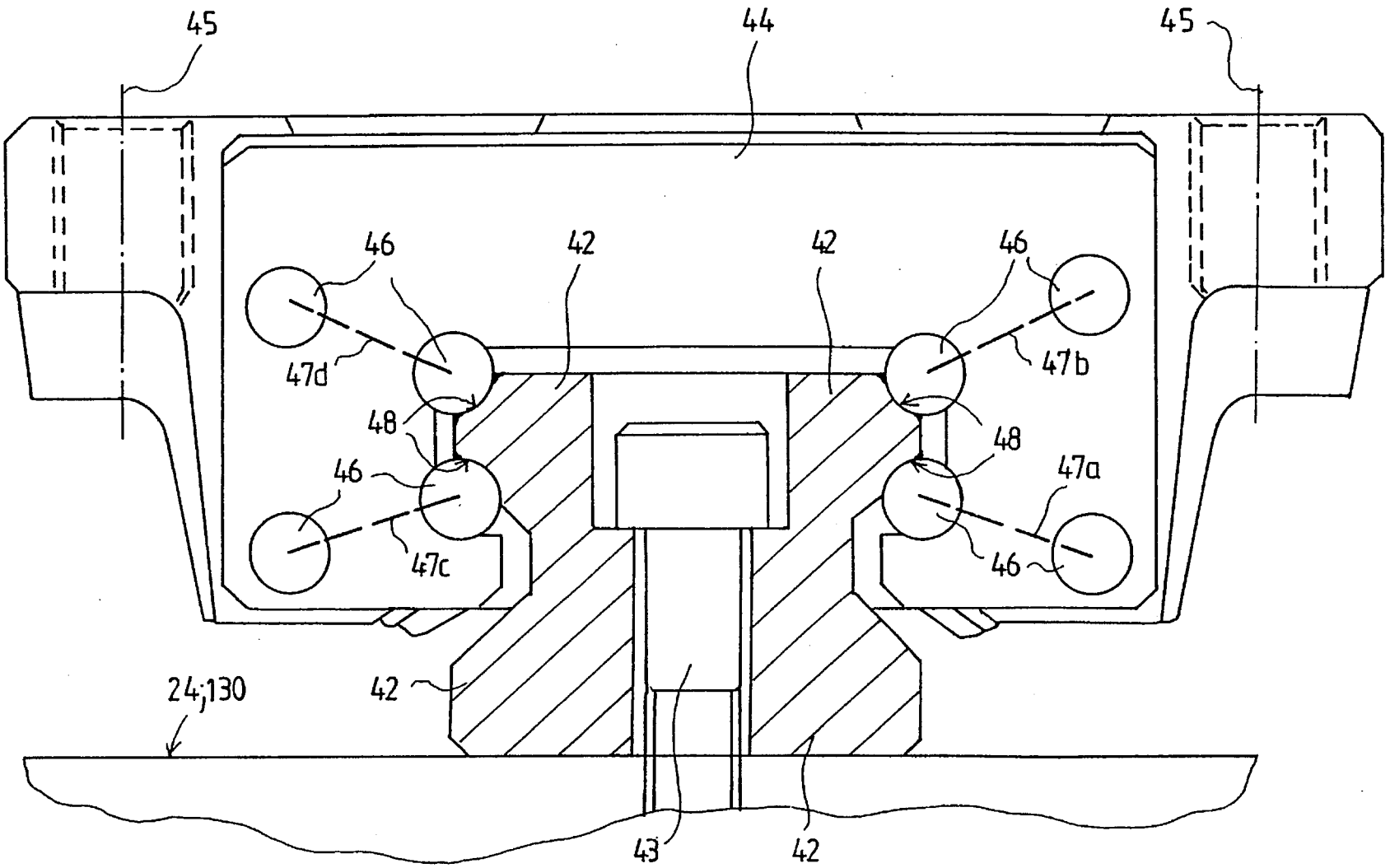
FIG. 10 shows a linear ball-bearing guide that is preferably used in tensioning apparatuses in accordance with the present invention.

Referring to FIG. 10, a preferred embodiment of the linear bearing arrangement of the sledges 40*a*,40*b* and an exemplifying embodiment of the guides will be described. The pairs of guide rails 42 at the driving side and at the operating side are fixed to the frame beams 24,130 or equivalent by means of screws 43. On the guide rails 42, linear ball bearings 44 move. The ball bearings 44 are fixed to the sledges 40*a*,40*b* by means of screws 45.

As shown in FIGS. 3 and 7, there are three pairs of linear ball bearings 44 which are uniformly spaced on both sledges 40*a*,40*b*. The linear ball bearings 44 are characterized by high loading capacity in all different directions transverse to the longitudinal direction of the guide rails 42, as well as by rigidity and by adjustable small plays and relatively low friction. The linear guides of the sledges 40*a*,40*b* comprise the guide rails 42, onto which four axial rolling grooves 48 for the bearing balls 46 are made. On the guide rails 42, the ball-bearing units 44 move, and have in an interior thereof, bearing balls 46 which perform a closed circulating movement in the loops 47*a*,47*b*,47*c*,47*d* such that numerous successive balls are supported "in turn" with their carrying portions in the rolling grooves 48 that are provided on the guide rails 42 in pairs. The rolling grooves 48 on the guide rail 42 are placed in pairs and preferably symmetrically so that each carrying row of bearing balls 46 transfers the contact load between the guide rail 42 and the ball-bearing unit 44 at an angle of about 45° when examined in the sectional plane of FIG. 10. In this way, an equally high loading capacity is obtained in the four different directions, which permits the tensioning apparatuses in accordance with the invention to be placed in all sorts of different positions without substantial alterations of construction. The linear guides 42,44 mentioned above are commercially available bearing components in themselves known.

The examples provided above are not meant to be exclusive. Many other variations of the present invention would be obvious to those skilled in the art, and are contemplated to be within the scope of the appended claims.

We claim:

1. Apparatus for tensioning a fabric in a paper machine, comprising a frame defining a driving side of the apparatus on a first side thereof and an operating side of the apparatus at a second side thereof opposite to said first side, a tensioning roll mounted on said frame and arranged in a loop of the fabric, bearing supports for supporting ends of said tensioning roll, sledges to which said bearing supports are fixed at the driving side and at the operating side of the apparatus, a drive motor for moving said sledges synchronously in relation to one another to thereby regulate the tension in the fabric that runs over said tensioning roll, linear guide means for guiding movement of said sledges in a substantially linear direction, said linear guide means comprising linear guide rails coupled to said frame and linear ball-bearing units coupled to said sledges, said linear ball-bearing units engaging with said linear guide rails, shafts journalled on said sledges and operated by said motor to displace said sledges guided along said linear guide rails of said linear guide means, and synchronization means for synchronizing said shafts journalled on said sledges and thus the movement of said sledges.

2. The apparatus of claim 1, wherein said motor is connected to one of said sledges situated at the operating side of the apparatus.

3. The apparatus of claim 1, wherein said linear guide means comprise a pair of said linear guide rails arranged parallel to one another at each of the driving side and the operating side of the apparatus, each of said pairs of parallel guide rails being spaced a short horizontal distance from one another, and at least two of said linear ball-bearing units being arranged to cooperate with each of said pairs of parallel guide rails.

4. The apparatus of claim 3, further comprising racks arranged in gaps between each of said pairs of parallel guide rails, said racks having teeth arranged on an outer face thereof and being connected to said frame, and said shafts being rotatably coupled to said motor and having cogwheels, said teeth of said racks being in a toothed engagement with said cogwheels such that rotation of said drive shafts causes movement of said sledges.

5. The apparatus of claim 4, further comprising telescopic box constructions for covering said racks and the gaps between each of said pairs of parallel guide rails.

6. The apparatus of claim 1, further comprising racks arranged proximate to said linear guide rails, said racks having teeth arranged on an outer face thereof and being connected to said frame, and said shafts being rotatably coupled to said motor and having cogwheels, said teeth of said racks being in a toothed engagement with said cogwheels such that rotation of said drive shafts causes movement of said sledges.

7. The apparatus of claim 6, wherein said teeth on said racks are arranged in relation to a support plane of said guide rails such that the distance between said teeth of said racks and said support plane is about 100 mm to about 200 mm.

8. The apparatus of claim 1, wherein said guide rails comprise four axial rolling grooves which receive bearing balls, said bearing balls performing a loop-shaped circulating movement in said ball bearing units and being supported, each in turn in respect of their carrying portions, to said rolling grooves.

9. The apparatus of claim 1, wherein said sledges and said linear guide means are arranged substantially symmetrical in relation to a vertical center plane in the machine direction.

10. The apparatus of claim 1, wherein said apparatus has a relatively small height from a support plane of said linear guide means to a central axis of said tensioning roll, the height being about 600 mm.

11. The apparatus of claim 1, wherein the fabric is a press felt, said apparatus further comprising a splice-turning device having a power unit arranged between one of said bearing supports and said sledge arranged in connection with said one of said bearing supports.

12. The apparatus of claim 11, further comprising linear guide fittings arranged on said sledges, said power unit further comprising a worm gear rotated by said drive shaft to displace said bearing support in said guide fittings.

13. The apparatus of claim 1, wherein said synchronization means comprise a synchronization shaft.

14. The apparatus of claim 1, wherein said linear guide means are loaded in different directions transverse to the substantially linear direction of the movement of said sledges.

15. A method for tensioning a fabric in a paper machine, comprising the steps of:

mounting a tensioning roll on a frame in the paper machine in a loop of a fabric wherein said frame defines a driving side of the apparatus on a first side thereof and an operating side of the apparatus on a second side thereof opposite to said first side, supporting ends of said tensioning roll on bearing supports, securing said bearing supports to movable sledges, arranging a splice-turning device between at least one of said bearing supports and said sledge arranged in connection therewith to shift said at least one of said bearing supports in relation to said sledge arranged in connection therewith, arranging linear guides on the frame to guide movement of said sledges in a substantially linear direction, said linear guides comprising linear guide rails arranged at each one of the driving side and the operating side of the apparatus, and linear ball-bearing units connected to said sledges and arranged to cooperate with each of said pairs of guide rails, providing racks connected to the frame and arranged proximate to said linear guide rails, said racks having teeth arranged on an outer face thereof, and moving said sledges by rotating drive shafts journalled on said sledges, said drive shafts having cogwheels engaging with said teeth of said racks in a toothed engagement such that rotation of said drive shafts causes the movement of said sledges along said racks to thereby regulate the tension in the fabric that runs over said tensioning roll.

16. The method of claim 15, further comprising arranging said sledges and said linear guides substantially symmetrical in relation to a vertical center plane in the machine direction of the apparatus.

17. The method of claim 15, wherein the fabric is a press felt, the method further comprising arranging linear guide fittings on said sledge to which said at least one of said bearing supports is arranged in connected therewith, and arranging a worm gear to be rotated by one of said shafts to displace said at least one of said bearing supports in said guide fittings and change the alignment of the tensioning roll.

18. Apparatus for tensioning a press felt in a paper machine, comprising a frame defining a driving side of the apparatus on a first side thereof and an operating side of the apparatus on a second side thereof opposite to said first side, a tensioning roll mounted on said frame and arranged in a loop of the press felt, bearing supports for supporting ends of said tensioning roll, sledges to which said bearing supports are fixed at the driving side and at the operating side of the apparatus, a drive motor for moving said sledges synchronously in relation to one another to thereby regulate the tension in the press felt that runs over said tensioning roll, linear guide means for guiding movement of said sledges in a substantially linear direction, shafts journalled on said sledges and operated by said motor to displace said sledges guided by said linear guide means, synchronization means for synchronizing said shafts journalled on said sledges and thus the movement of said sledges, and a splice-turning device having a power unit arranged between one of said bearing supports and said sledge arranged in connection with said one of said bearing supports, said splice-turning device enabling displacement of said one of said bearing supports relative to said sledge arranged in connection therewith.

19. Apparatus for tensioning a press felt in a paper machine, comprising a frame defining a driving side of the apparatus on a first side thereof and an operating side of the apparatus on a second side thereof opposite to said first side, a tensioning roll mounted on said frame and arranged in a loop of the press felt, bearing supports for supporting ends of said tensioning roll, sledges to which said bearing supports are fixed at the driving side and at the operating side of the apparatus, a drive motor for moving said sledges synchronously in relation to one another to thereby regulate the tension in the press felt that runs over said tensioning roll, linear guide means coupled to said frame for guiding movement of said sledges in a substantially linear direction, said linear guide means being loaded in different directions transverse to the substantially linear direction of the movement of said sledges, shafts journalled on said sledges and operated by said motor to displace said sledges guided by said linear guide means, and synchronization means for synchronizing said shafts on said sledges and thus the movement of said sledges.

* * * * *